US005331711A

United States Patent [19]

Kelly

[11] Patent Number: 5,331,711

[45] Date of Patent: Jul. 26, 1994

[54] TOOL FOR CLEANING CROSS CONVEYOR ASSEMBLY AND OTHER PARTS OF A BOWLING MACHINE PINSETTER

[76] Inventor: Michael W. Kelly, 302 6th St. Apt. 2, Glassport, Pa. 15045

[21] Appl. No.: 81,168

[22] Filed: Jun. 25, 1993

[51] Int. Cl.[5] ..... A47L 25/00

[52] U.S. Cl. ..... 15/210.1; 15/228; 15/247

[58] Field of Search ..... 15/105, 160, 209.1, 15/210.1, 228, 231, 232, 244.1-244.3, 247

[56] References Cited

U.S. PATENT DOCUMENTS

| | | | |
|---|---|---|---|
| 1,353,429 | 9/1920 | Severns | 15/231 |
| 2,301,586 | 11/1942 | Rubin | 15/247 |
| 2,304,127 | 12/1942 | Stetson | 15/231 |
| 2,811,734 | 11/1957 | Mee | 15/228 |
| 3,012,264 | 12/1961 | Nash | 15/247 |
| 3,099,855 | 8/1963 | Nash | 15/244.2 |
| 3,465,377 | 9/1969 | Thomas | 15/231 |
| 4,658,461 | 4/1987 | Roe et al. | 15/210.1 |

FOREIGN PATENT DOCUMENTS

| | | | |
|---|---|---|---|
| 608310 | 4/1926 | France | 15/231 |
| 798408 | 3/1936 | France | 15/247 |
| 354636 | 8/1931 | United Kingdom | 15/105 |

*Primary Examiner*—Harvey C. Hornsby
*Assistant Examiner*—Mark Spisich
*Attorney, Agent, or Firm*—William J. Ruano

[57] ABSTRACT

A tool for cleaning parts of a bowling machine. The tool includes a base plate having a handle pivotally secured thereto between two opposed side walls and including a planar forward portion having a notch therein which is adapted to manipulate a latch in a bowling machine. A cleaning cloth is provided to substantially cover the base plate and outward portions of the side walls.

4 Claims, 3 Drawing Sheets

TOOL FOR CLEANING CROSS CONVEYOR ASSEMBLY AND OTHER PARTS OF A BOWLING MACHINE PINSETTER

BACKGROUND OF THE INVENTION

Heretofore, it has been time consuming and a potential hazard to the hands when cleaning various parts of a bowling machine.

SUMMARY OF THE INVENTION

A tool for cleaning parts of a bowling machine pin setter comprising a rectangular base with sides of unequal height and an inwardly tapered forward extension having a central cut out. A handle is pivotally attached centrally of the rectangular base. A wiping pad or cleaning cloth has sides attached to the outer sides of the tool and a front portion folded over the cut out. A separate cleaning cloth or muff, when used, overlies the rectangular base and sides and may project to or beyond the rear end of the rectangular base.

DESCRIPTION OF THE PREFERRED EMBODIMENT

Figure 3:
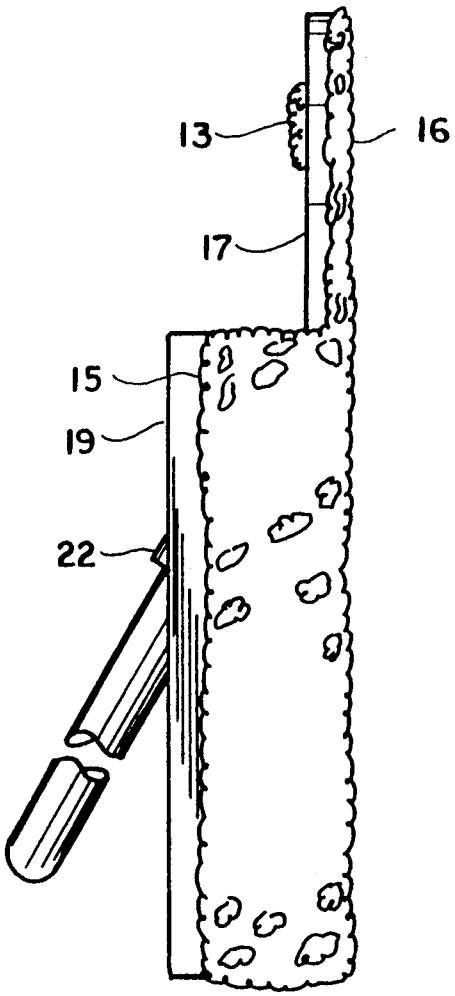
FIG. 3 is a right side view.
Figure 2:
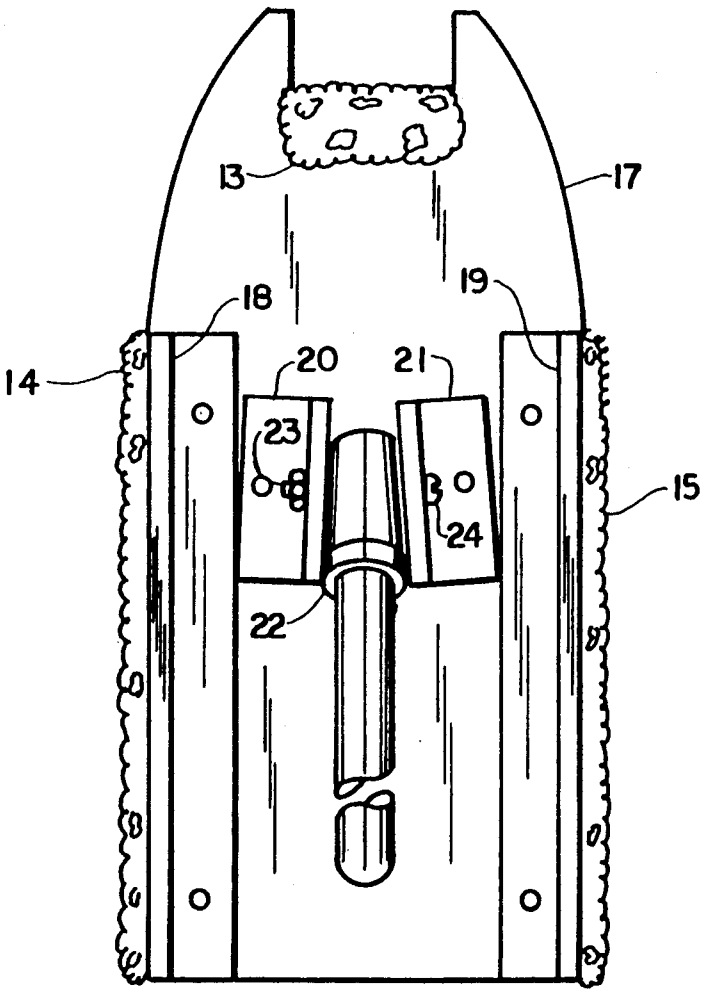
FIG. 2 is a top view.
Figure 1:
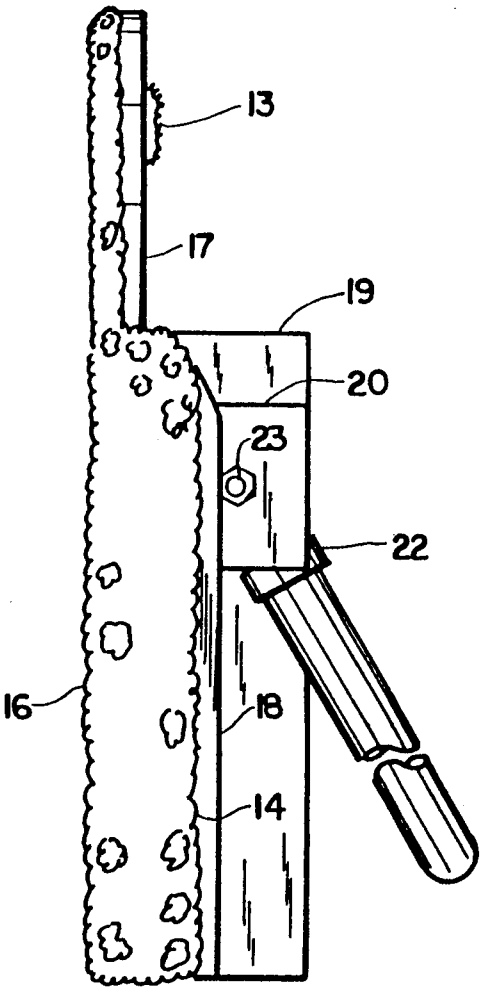
FIG. 1 is a left side view of the cleaning tool.
Figure 4:
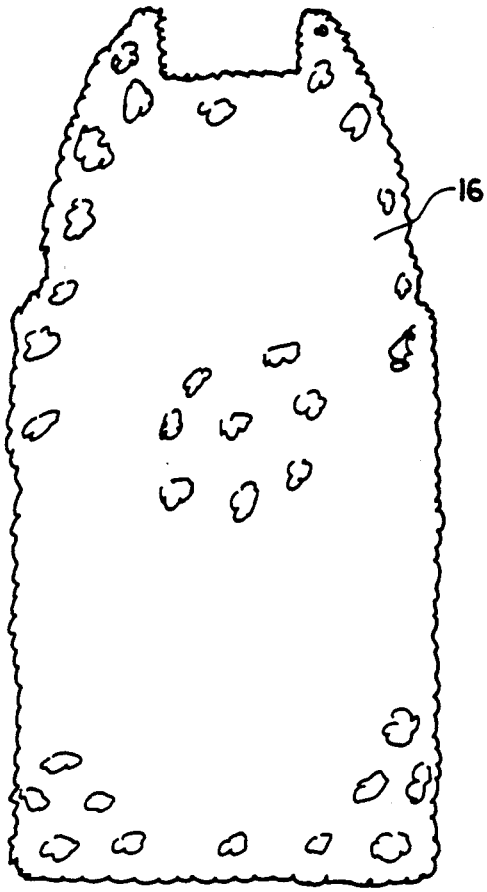
FIG. 4 is a bottom view and FIG. 5 is a rear view thereof.
Figure 5:
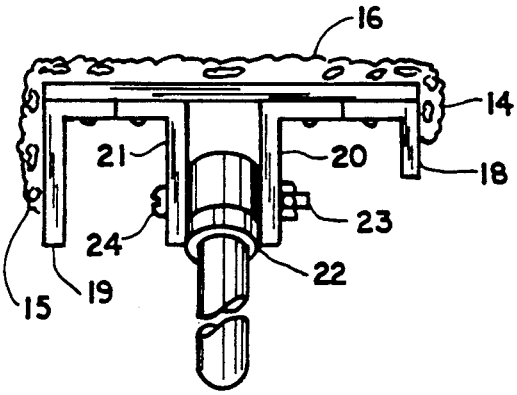

The tool of the present invention, best shown in FIGS. 1-5 inclusive, comprises a metal or plastic base plate 17 having integral upstanding sidewalls 18 and 19, one (18) about ⅜ inch and the other, (19) about ¾ inch in height to distinctly clean rake sweep cam. As shown in FIG. 5, a first covering cloth 14, 15, 16 is attached to the outside surface of sidewalls 18 and 19 and bottom plate 17. As shown in FIG. 2, a portion 13 of the first covering cloth 16 is overlapped at the base of an opening of about 1⅛ inch wide and ½ inch deep in the inwardly tapered front portion of base plate 17, which opening is for engaging and depressing pin gate lever 6 which .locks latch 10 and at the end of the cleaning cycle which opening of the tool engages and lifts latch 10 which, in turn, unlocks latch 10 freeing pingate lever 6.

On the center of the base plate 17, there is mounted two L shaped plates 20 and 21 for pivotally supporting an internally threaded cylindrical base 22 onto which a handle is screw threadedly attached by a bolt having a head 24 and threaded shank 23.

Figure 6:
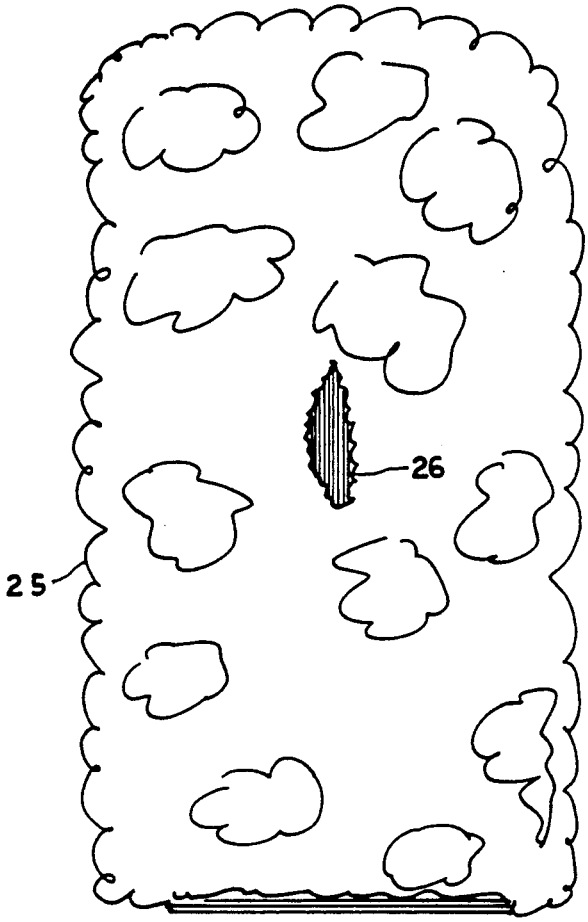
FIG. 6 shows a separate cleaning cloth or muff and FIG. 7 is a end view thereof showing an openings,- the other end being totally enclosed.
Figure 7:
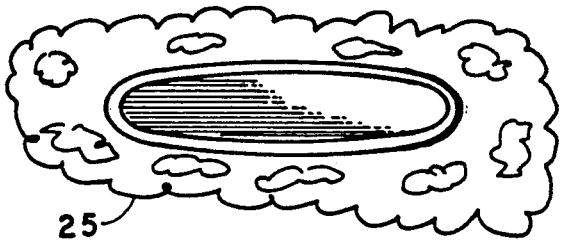

A second cleaning cloth or muff 25, shown in FIGS. 6 and 7 is slipped over the tool and is detachably supported by sidewalls 18 & 19.

The second cleaning cloth 25 may extend across and beyond the rear of sidewalls 18 & 19.

Figure 8:
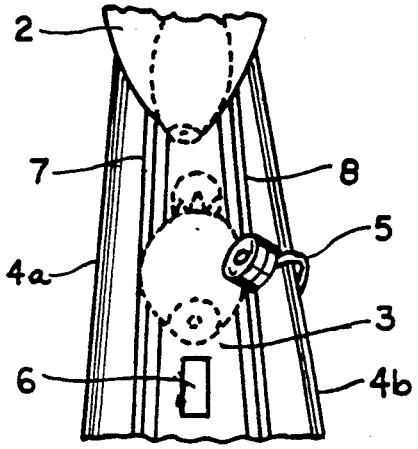
FIG. 8 shows a top perspective view of a cross conveyor assembly of a bowling machine pin setter which can be cleaned by the present cleaning tool.

FIG. 8 shows a conventional turnaround pan for bowling pins, such as 2, fed on pin bottom or base plate 3 having side plates 4a and 4b; a magnetic clutch trip lever 5 and pin gate lever 6.

Figure 9:
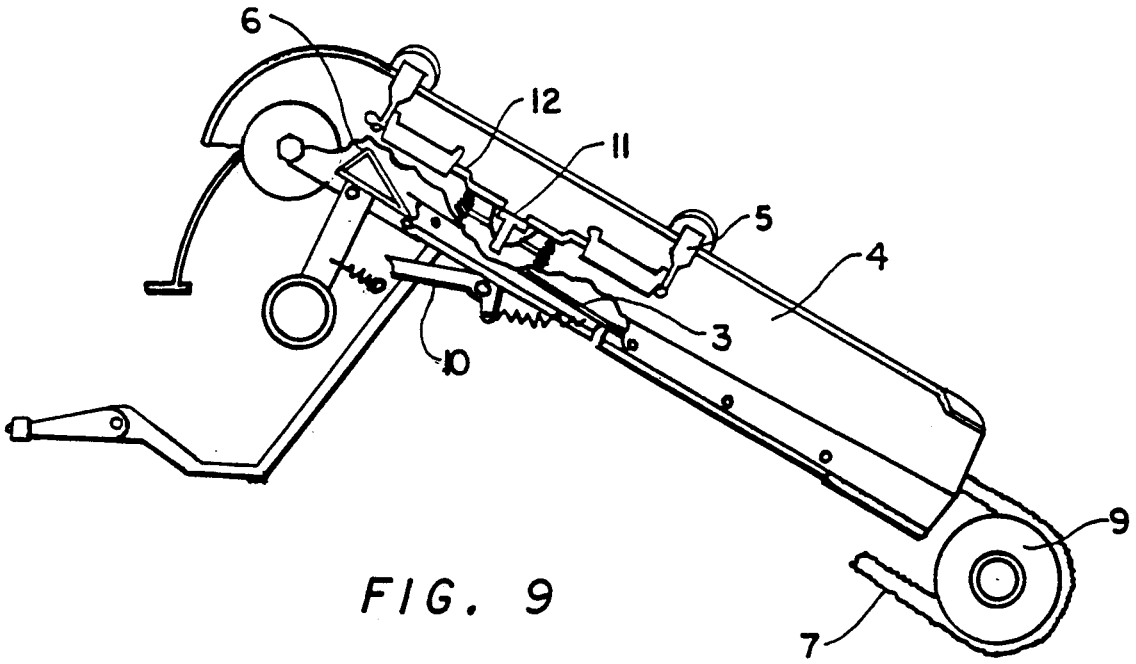
FIG. 9 is a cross conveyor pin gate as viewed from the left side of the machine.

FIG. 9 shows a cross conveyor with a bottom plate 3, side plates 4, magnetic clutch trip lever 5 and an unlocked pin gate latch 10, a microswitch 11 and a pin tripping lever 12.

FIGS. 1-5 show the tool of the invention used for a wiping stroke of the pin support plate 3.

FIGS. 6 and 7 show a second cleaning cloth or muff which may be applied to the tool for use when the tool is either in its normal or inverted position, depending upon the part of the machine to be cleaned.

In operation and referring to FIG. 9, when the tool is applied for cleaning base plate 3, the magnetic clutch lever 5 is lifted and pin gate lever 6 is operated by the opening in the front portion of the tool.

I claim:

1. A cleaning tool for cleaning parts of a bowling machine comprising:

a substantially planar base plate having first and second sides;

first and second upstanding side walls extending from the first side of the base plate at opposite peripheral portions thereof;

said base plate having a portion thereof extending beyond said side walls which defines a substantially planar portion extending forwardly of the side walls, said forwardly extending portion of the base plate including a notch formed in a free end thereof;

an elongated handle pivotally secured to the first side of the base plate; and a cleaning cloth adhered to and substantially covering outwardly facing surfaces of the side walls, the second side of the base plate and the forwardly extending portion thereof.

2. A tool as recited in claim 1 wherein said upstanding side walls are of different heights.

3. A tool as recited in claim 1 together with a second wiping cloth adapted to cover said base plate in spaced relationship thereto such that it is supported by inner surfaces of said upstanding side walls.

4. A tool recited in claim 1 wherein said notch in forwardly extending portion of the base plate is adapted to manipulate a latch in a bowling machine.

* * * * *